US007782198B2

(12) United States Patent
Crockett et al.

(10) Patent No.: US 7,782,198 B2
(45) Date of Patent: Aug. 24, 2010

(54) APPARATUS AND METHOD FOR DETECTING TAMPERING OF A PRINTER COMPARTMENT

(75) Inventors: Timothy Wayne Crockett, Raleigh, NC (US); Julie A. Morris, Raleigh, NC (US); James Manson White, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 321 days.

(21) Appl. No.: 11/949,461

(22) Filed: Dec. 3, 2007

(65) Prior Publication Data

US 2009/0140869 A1 Jun. 4, 2009

(51) Int. Cl.
*G08B 13/00* (2006.01)

(52) U.S. Cl. ..... 340/541; 312/223.2; 705/57

(58) Field of Classification Search ..... 340/541; 312/223.2; 705/57, 64, 408; 713/194
See application file for complete search history.

(56) References Cited

U.S. PATENT DOCUMENTS 4,804,945 A 2/1989 Millet
4,813,912 A 3/1989 Chickneas et al.
5,081,444 A 1/1992 Nicholson et al.
5,281,018 A * 1/1994 Cullinan ..... 312/223.2
5,526,271 A * 6/1996 Abumehdi ..... 705/408
5,801,340 A 9/1998 Peter
5,970,875 A * 10/1999 Hoffmann et al. ..... 101/491
6,144,950 A * 11/2000 Davies et al. ..... 705/401
7,028,014 B1 4/2006 Naclerio
7,341,334 B2 * 3/2008 Auslander et al. ..... 347/85
2004/0148261 A1 * 7/2004 Abe ..... 705/57
2004/0255141 A1 12/2004 Hodder et al.
2005/0111039 A1 * 5/2005 Yoshida ..... 358/1.16
2009/0182640 A1 * 7/2009 Hodder et al. ..... 705/19

* cited by examiner

*Primary Examiner*—John A Tweel, Jr.
(74) *Attorney, Agent, or Firm*—Yee & Associates, P.C.; Jason O. Piche

(57) ABSTRACT

The illustrative embodiments described herein provide an apparatus and method for detecting tampering. The apparatus includes a printer and a printer compartment located within the printer. The apparatus also includes a switch capable of being coupled to the printer compartment. The switch is adapted to close when tampering with the printer compartment occurs. The apparatus includes a tamper detection device capable of being in a tamper state and a non-tamper state. The tamper detection device discharges and places the tamper detection device in the tamper state when the switch is closed to indicate that tampering has occurred. The apparatus includes a set of power sources. The set of power sources provides charge to the tamper detection device and places the tamper detection device in the non-tamper state.

20 Claims, 4 Drawing Sheets

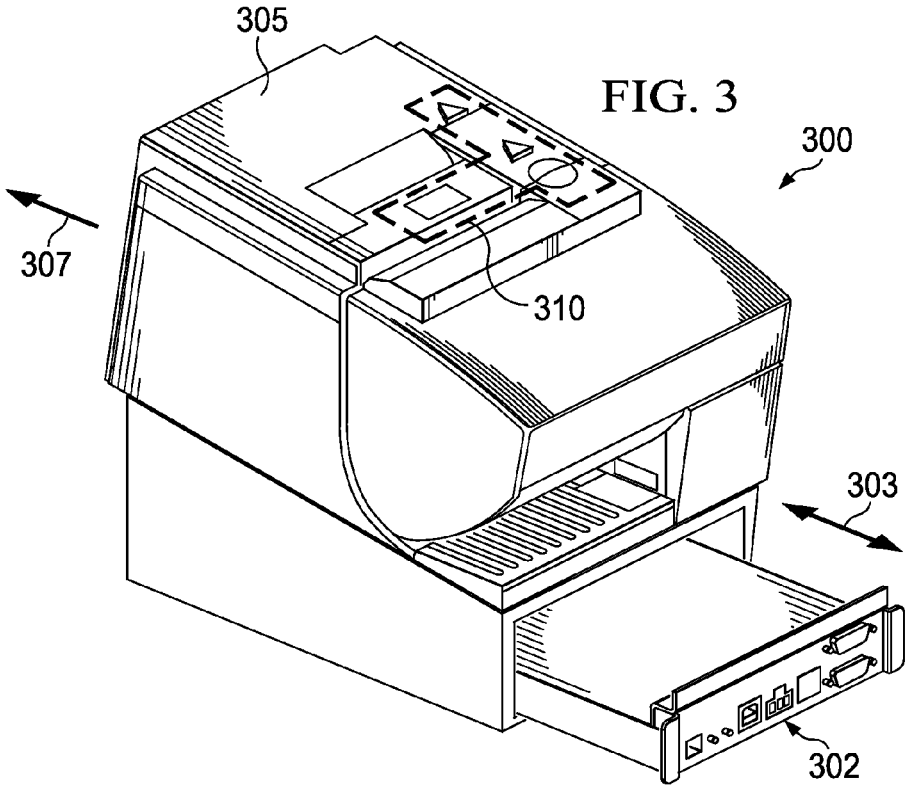
FIG. 3
FIG. 4
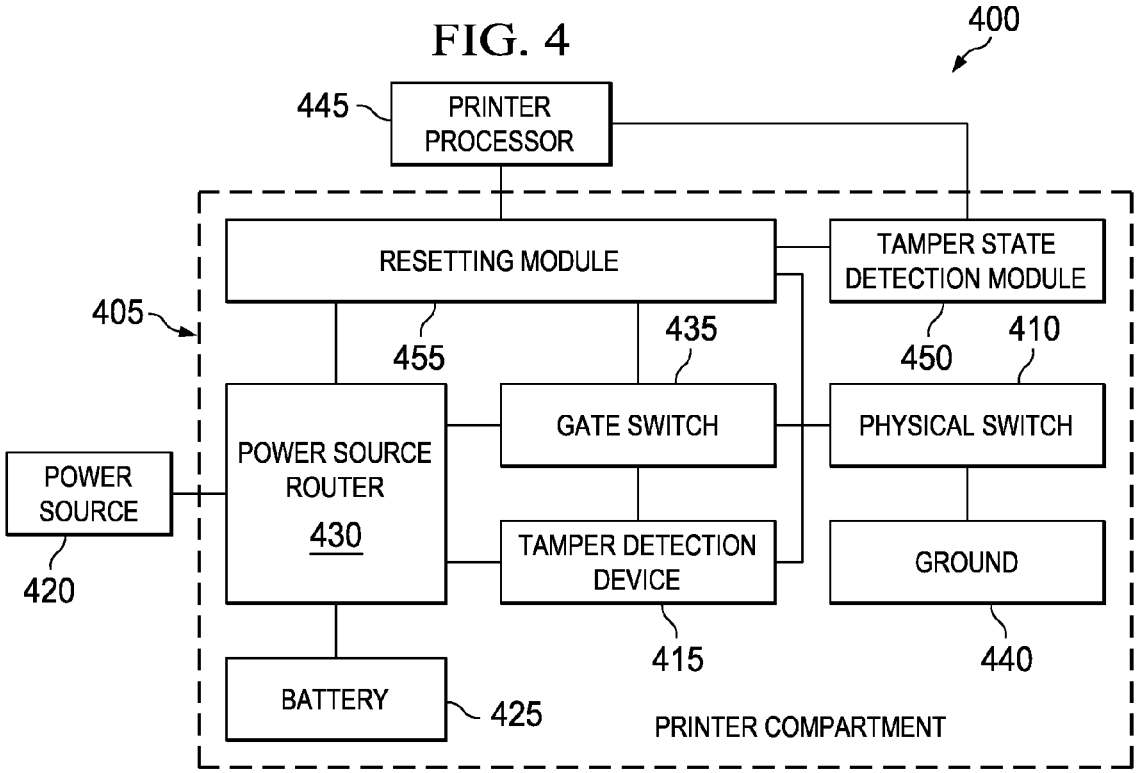

APPARATUS AND METHOD FOR DETECTING TAMPERING OF A PRINTER COMPARTMENT

BACKGROUND OF THE INVENTION

1. Field of the Invention

The invention relates generally to an apparatus and method for detecting tampering. More particularly, the present invention relates to an apparatus and method for detecting tampering of a printer compartment.

2. Description of the Related Art

Most types of printers have compartments in which printer contents may be contained. For example, a printer may have a compartment in which printer paper is contained. In another example, a printer may have a compartment that contains circuitry, such as a processor.

In some cases, a printer compartment may contain sensitive contents. In these cases, one may desire to prevent someone from tampering with the sensitive contents. Tampering is any contact with an object or data that is considered undesirable by at least one party, such as a government, individual, or some other entity.

For example, some countries enforce fiscal laws that require retailers to keep special records of their transaction data using fiscal printers. A fiscal printer is a type of printer that is used at a point of sale to facilitate a transaction. A fiscal printer uses an existing single or double station printer platform and adds logic that complies with a government's law. This logic may contain data records of transactions involving the fiscal printer. The logic is contained in a printer drawer that slides into the printer beneath the existing printer platform.

The fiscal printer, and in particular the printer drawer containing the logic, may need to meet tamper-proof requirements set by a particular government. For example, a law may require that a "tamper" state be evident if the printer drawer containing the logic is pulled out of the printer by more than a threshold distance. The law may also require that a printer be unable to operate until a government agent resets the printer.

One current method for tamper proofing the printer drawer uses a special screw to prevent the drawer from being pulled out of the printer. The special screw is sealed such that the seal is broken if the drawer is pulled out of the printer. However, this method requires that a special technician replace the seal after the seal is broken, thereby increasing the cost and labor required to implement this method. Also, one can detect whether the drawer has been tampered with only by visual inspection.

Another current method for tamper proofing the contents of the printer drawer embeds the printed circuit boards containing the logic in epoxy. For example, these printed circuit boards may be a fiscal memory and an electronic journal. However, in this method, visible inspection is required to determine whether an attempt has been made to tamper with the printed circuit boards. Furthermore, in the event that a tamper has occurred, a special technician may be needed to restore the circuitry to an original state.

Another current method for tamper proofing the contents of the printer drawer places a physical cover, such as a plastic box, over the electrically programmable read-only memory that is used in the logic. For example, the electrically programmable read-only memory may contain code that manages the operation of the printer. However, as in the other current methods, visible inspection is required to determine whether an attempt has been made to tamper with the electrically programmable read-only memory. Also, in the event that a tamper has occurred, a special technician may be needed to restore the circuitry to an original state, such as by replacing the physical cover.

BRIEF SUMMARY OF THE INVENTION

The illustrative embodiments described herein provide an apparatus and method for detecting tampering. The apparatus includes a printer and a printer compartment located within the printer. The apparatus also includes a switch capable of being coupled to the printer compartment. The switch is adapted to close when tampering with the printer compartment occurs. The apparatus includes a tamper detection device capable of being in a tamper state and a non-tamper state. The tamper detection device discharges and places the tamper detection device in the tamper state when the switch is closed to indicate that tampering has occurred. The apparatus includes a set of power sources. The set of power sources provides charge to the tamper detection device and places the tamper detection device in the non-tamper state.

BRIEF DESCRIPTION OF THE SEVERAL VIEWS OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 3 is an illustration of a printer used to expose printable media in accordance with an illustrative embodiment;

FIG. 4 is a block diagram of a system for detecting a tamper state for a printer compartment in accordance with an illustrative embodiment;

DETAILED DESCRIPTION OF THE INVENTION

Figure 1:
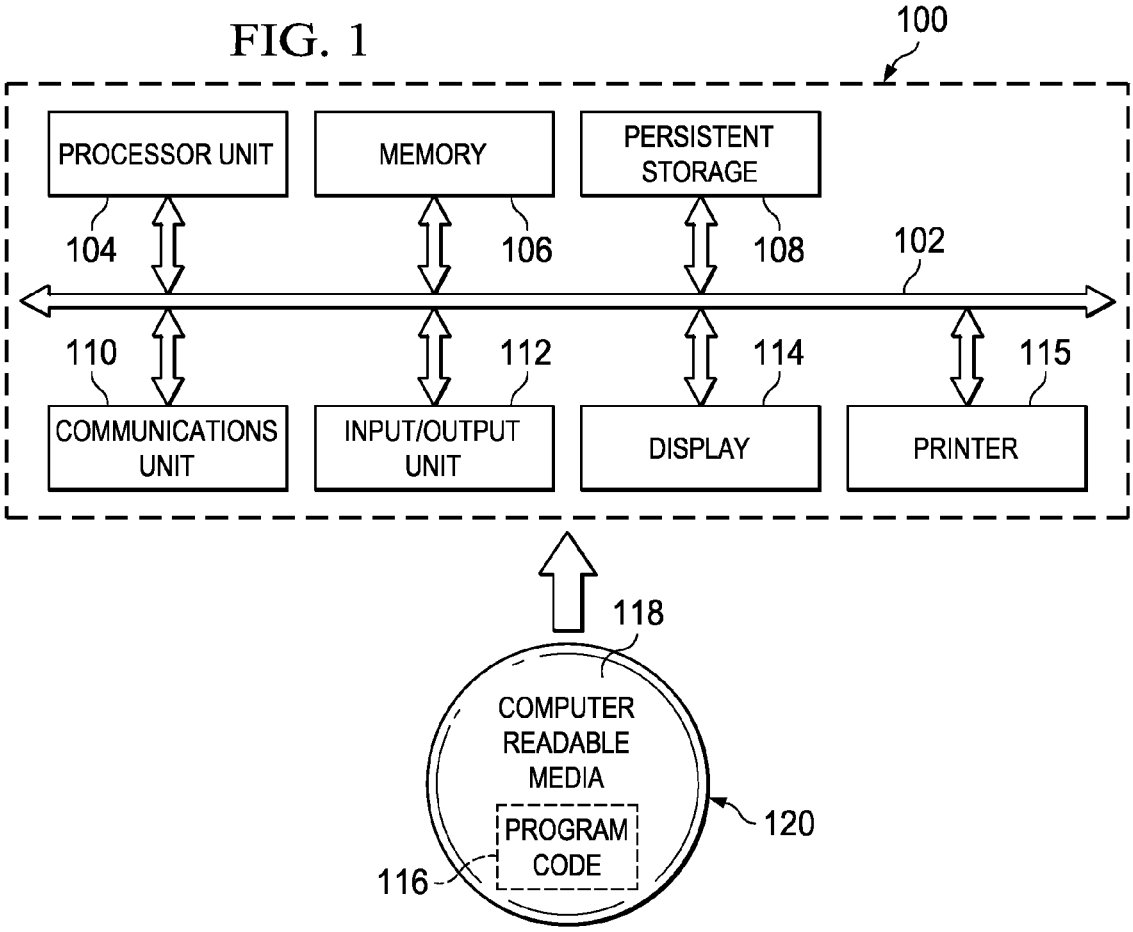
FIG. 1 is a block diagram of a data processing system in accordance with an illustrative embodiment of the present invention.

Turning now to FIG. 1, a block diagram of a data processing system is depicted in accordance with an illustrative embodiment of the present invention. In this illustrative example, data processing system 100 includes communications fabric 102, which provides communications between processor unit 104, memory 106, persistent storage 108, communications unit 110, input/output (I/O) unit 112, display 114, and printer 115.

Processor unit 104 serves to execute instructions for software that may be loaded into memory 106. Processor unit 104 may be a set of one or more processors or may be a multiprocessor core, depending on the particular implementation. Further, processor unit 104 may be implemented using one or more heterogeneous processor systems in which a main processor is present with secondary processors on a single chip. As another illustrative example, processor unit 104 may be a symmetric multi-processor system containing multiple processors of the same type.

Memory 106, in these examples, may be, for example, a random access memory. Persistent storage 108 may take various forms depending on the particular implementation. For example, persistent storage 108 may contain one or more components or devices. For example, persistent storage 108 may be a hard drive, a flash memory, a rewritable optical disk, a rewritable magnetic tape, or some combination of the above. The media used by persistent storage 108 also may be removable. For example, a removable hard drive may be used for persistent storage 108.

Communications unit 110, in these examples, provides for communications with other data processing systems or devices. In these examples, communications unit 110 is a network interface card. Communications unit 110 may provide communications through the use of either or both physical and wireless communications links.

Input/output unit 112 allows for input and output of data with other devices that may be connected to data processing system 100. For example, input/output unit 112 may provide a connection for user input through a keyboard and mouse. Further, input/output unit 112 may send output to printer 115. Display 114 provides a mechanism to display information to a user.

Instructions for the operating system and applications or programs are located on persistent storage 108. These instructions may be loaded into memory 106 for execution by processor unit 104. The processes of the different embodiments may be performed by processor unit 104 using computer implemented instructions, which may be located in a memory, such as memory 106. These instructions are referred to as, program code, computer usable program code, or computer readable program code that may be read and executed by a processor in processor unit 104. The program code in the different embodiments may be embodied on different physical or tangible computer readable media, such as memory 106 or persistent storage 108. In one embodiment, the program code relates to printing a receipt on printer 115 for transactions that occur at a point of sale.

Printer 115 may be used to print any type of document. Instructions may be sent to printer 115 on communications fabric 102 to provide printer 115 with a set of parameters relating to the printing of one or more documents. The phrase "a set" as used herein refers to one or more items. For example, a set of parameters is one or more parameters. These parameters may contain, for example, data that should be printed on a receipt to be printed by printer 115 at a point of sale. Also, because printer 115 is compatible with a variety of different operating systems, such as Microsoft® Windows® or Unix®, instructions may be sent to printer 115 regardless of the operating system executing on data processing system 100. Microsoft® and Windows® are trademarks of Microsoft Corporation in the United States, other countries, or both. UNIX® is a registered trademark of The Open Group. Printer 115 may be connected to one or more of the other components of the FIG. 1 via a direct connection, such as a bus, or over a network, such as the Internet.

Printer 115 may also contain one or more tamper detection devices that identify whether printer 115 has been tampered with. For example, these tamper detection devices may identify whether a particular compartment of printer 115 has been tampered with.

Program code 116 is located in a functional form on computer readable media 118 and may be loaded onto or transferred to data processing system 100 for execution by processor unit 104. Program code 116 and computer readable media 118 form computer program product 120 in these examples. In one example, computer readable media 118 may be in a tangible form, such as, for example, an optical or magnetic disc that is inserted or placed into a drive or other device that is part of persistent storage 108 for transfer onto a storage device, such as a hard drive that is part of persistent storage 108. In a tangible form, computer readable media 118 also may take the form of a persistent storage, such as a hard drive or a flash memory that is connected to data processing system 100. The tangible form of computer readable media 118 is also referred to as computer recordable storage media.

Alternatively, program code 116 may be transferred to data processing system 100 from computer readable media 118 through a communications link to communications unit 110 and/or through a connection to input/output unit 112. The communications link and/or the connection may be physical or wireless in the illustrative examples. The computer readable media also may take the form of non-tangible media, such as communications links or wireless transmissions containing the program code.

The different components illustrated for data processing system 100 are not meant to provide architectural limitations to the manner in which different embodiments may be implemented. The different illustrative embodiments may be implemented in a data processing system including components in addition to or in place of those illustrated for data processing system 100. Other components shown in FIG. 1 can be varied from the illustrative examples shown.

For example, a bus system may be used to implement communications fabric 102 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 106 or a cache such as found in an interface and memory controller hub that may be present in communications fabric 102.

Figure 2:
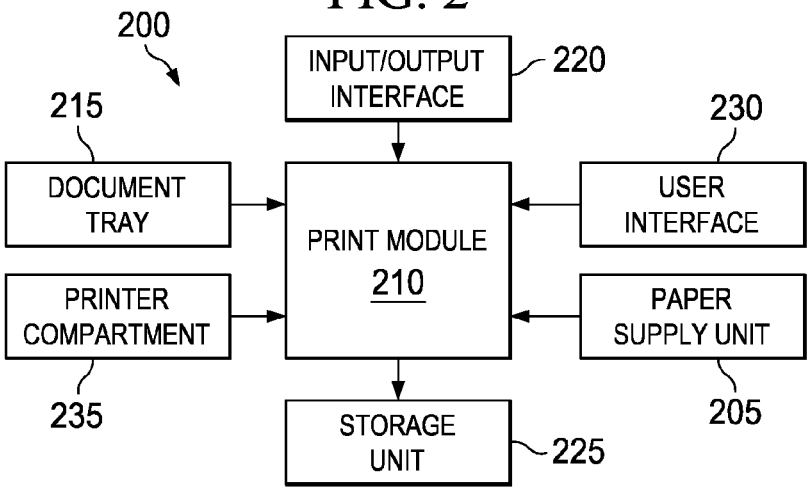
FIG. 2 is a block diagram of a printer in which the illustrative embodiments may be implemented.

Turning now to FIG. 2, a block diagram of a printer is depicted in which the illustrative embodiments may be implemented. Printer 200 is a non-limiting example of printer 115 in FIG. 1. In this illustrative example, printer 200 may be any type of printer, such as a thermal printer, toner-based printer, liquid inkjet printer, solid ink printer, dye-sublimation printer, inkless printer, impact printer, daisy wheel printer, dot-matrix printer, line printer, or a pen-based plotter. Printer 200 may used in any type of application, such as a fiscal printer, an office printer, or a home-use printer. A fiscal printer may be a point of sale printer.

Printer 200 includes paper supply unit 205. Paper supply unit 205 holds printable media that is used by printer 200 to print documents. The printable media in paper supply unit 205 may takes a variety of forms, such as a roll of printable media or a stack of pre-cut sheets of printable media. The printable media may be made of any material that is capable of being printed on by printer 200, such as paper or heat-sensitive material.

Printer 200 includes print module 210. Print module 210 is hardware in printer 200 that prints on the printer media to create a document. For example, print module 210 may apply ink to paper in paper supply unit 205 using a toner. In another example, print module 210 uses thermal-printing techniques by selectively heating portions of a roll of heat-sensitive paper in paper supply unit 205. In another example, print module 210 applies ink to one or more sheets of pre-cut paper in paper supply unit 205.

Documents created in print module 210 exit printer 200 at document tray 215. The documents at document tray 215 may be retrieved by a user or by another device for processing.

Printer 200 includes input/output interface 220. Input/output interface 220 is an interface between the printer 200 and any external devices. Input/output interface 220 may be, for example, one or more ports into which a detachable storage device may be received. Input/output interface 220 may also be a connection port into which a computer, point of sale device, cash register, or any other data processing system is connected. For example, printer 200 may be connected to one or more of the components of data processing system 100 in FIG. 1 via input/output interface 220.

Data received at input/output interface 220 may be sent to other components of printer 200 and used in the creation of documents. For example, transaction information may be sent to printer 200 at input/output interface 220 from a point of sale device so that a receipt may be printed using a roll of heat-sensitive paper in paper supply unit 205. This data may be buffered or otherwise stored in storage unit 225. Storage unit 225 may be random access memory, a hard drive, or detachable forms of memory.

Printer 200 also includes user interface 230. User interface 230 includes any controls that allow a user to adjust settings for printer 200. For example, user interface 230 may include controls that allow a user to select a type of paper in paper supply unit 205 to be used to create a document. User interface 230 may also include a control, such as a button or knob, which opens a cover of printer 200. The cover may enclose the paper in paper supply unit 205. Alternatively, user interface 230 may be displayed on a graphical user interface of a data processing system that is connected to printer 200 via input/output interface 220.

Printer 200 also includes printer compartment 235. Printer compartment 235 is any portion of printer 200 that is capable of containing contents. Printer compartment 235 may be any type of physical compartment, such as a drawer or a compartment whose opening or cover may be slidably or hingably opened.

For example, in the example in which printer 200 is a fiscal printer, compartment 235 may contain one or more printed circuit boards that record data regarding transactions involving printer 200. These printed circuit boards facilitate compliance with governmental laws regarding the recordation of transaction data. In this example, one of the printed circuit boards may be a microprocessor card that controls the operation of printer 200. Another type of printed circuit board that may be included in printer compartment 235 is a fiscal memory card that stores daily sales totals and tax rate. Another type of printed circuit board that may be included in printer compartment 235 is an electronic journal card that stores transaction data that allows receipts to be recreated, if necessary. Also in this examples printer compartment 235 may contain one or more data ports that facilitate a connection between the printed circuit boards and an external device.

In additions the printed circuit boards in printer compartment 235 may include tamper detection features that identify whether printer compartment 235 has been tampered with. In one example, printer compartment 235 may trigger a physical switch when printer compartment 235 has been tampered with. A printed circuit board in printer compartment 235 may also determine whether printer compartment 235 is in a tamper state based on the position of the physical switch.

Turning now to FIG. 3, an illustration of a printer used to expose printable media is depicted in accordance with an illustrative embodiment. Specifically, FIG. 3 illustrates printer 300, which is a non-limiting example of printer 115 in FIG. 1 and printer 200 in FIG. 2.

In one non-limiting examples printer 300 is a fiscal printer. Printer 300 includes printer drawer 302, which is a non-limiting example of printer compartment 235 in FIG. 2. Printer drawer 302 slides in and out of printer 300 in the directions indicated by double arrows 303. Printer drawer 302 may contain printed circuit boards, such the microprocessor cards electronic journal cards and fiscal memory cards described with respect to FIG. 2. These cards may need to be secured pursuant to governmental regulation, thereby creating a need to prevent or detect tampering of printer drawer 302. Printer drawer 302 may also contain one or more data ports that facilitate a connection between the printed circuit boards and an external device. These data ports may be located on a portion of printer drawer 302 that faces the exterior of printer 300.

Printer 300 includes cover 305. Cover 305 is coupled to printer 300 and covers an area of printer 300 that holds printable media, such as a roll of paper. This area of printer 300 is a non-limiting example of printer compartment 235 in FIG. 2. Cover 305 may be coupled to printer 300 in a variety of ways. For example, cover 305 may rest on printer 300 without the aid of any connections at all. In another example, one side of cover 305 may be pivotably coupled to printer 300 such that any particular side of cover 305 may be lifted, thereby revealing the contents of printer 300 concealed by cover 305. The pivotable coupling between cover 305 and printer 300 may include one or more hinges, screws, or bolts. Cover 305 may also be slidably coupled to printer 300 such that cover 305 may slide off printer 300 in the direction indicated by arrow 307.

Cover 305 may be removed or opened in a variety of ways. For example, a user may manually move cover 305 into an open position. In another example, a user may open cover 305 using user interface controls 310. In this example, one of the buttons in user interface controls 310 may function to open cover 305. Cover 305 may also be opened by issuing instruction to printer 300 using a data processing system, such as data processing system 100 in FIG. 1.

The illustrative embodiments described herein provide an apparatus and method for detecting a tamper state for a printer compartment. The apparatus includes a printer having the printer compartment. The printer compartment may be located within the printer. In one embodiment, the printer is a fiscal printer. The apparatus also includes a switch coupled to the printer compartment. As used herein, the term "coupled" includes coupling via a separate object. For example, the switch may be coupled to the printer compartment if both the switch and the printer compartment are coupled to a third object, such as a wire. The term "coupled" also includes "directly coupled," in which case the two objects touch each other in some way. The term "coupled" also includes electrically coupled such that a conductive connection exists between two objects. The switch is adapted to close when tampering with the printer compartment occurs. When the switch is closed, the switch provides an electrical path to ground for at least one component other than the switch.

The apparatus includes a tamper detection device. A tamper detection device is any device capable of holding charge. The tamper detection device is capable of being in a tamper state and a non-tamper state. In one embodiment, the tamper detection device is a capacitor. The tamper detection device discharges and places the tamper detection device in the tamper state when the switch is closed to indicate that tampering has occurred. A tamper state is a state of the tamper detection device that indicates that the printer compartment has been tampered with.

In one embodiment, the printer compartment is a printer drawer. In this embodiment, the switch is adapted to close when a movement of the printer drawer exceeds a threshold distance, such as 5 millimeters. Thus, in this embodiment, the tamper detection device is discharged and indicates a tamper state if the movement of the drawer exceeds a threshold distance.

The apparatus also includes a set of power sources. The set of power sources includes one or more power sources. The set of power sources provides charge to the tamper detection device and places the tamper detection device in the non-tamper state. In one example, the set of power sources provides charge to the tamper detection device when the tamper detection device is in a non-tamper state. A non-tamper state is a state of the tamper detection device that indicates that the printer compartment has not been tampered with.

In one embodiment, the set of power sources comprises a first power source used by the printer and a battery. The first power source may be the same power source that provides power to the printer, such as plug-in power source.

In this embodiment, the apparatus also includes a power source router. The power source router chooses a particular power source in the set of power sources to provide charge to the tamper detection device when the tamper detection device is in the non-tamper state. For example, when the printer is turned on, the particular power source chosen by the power source router is the first power source. In another example, when the printer is turned off, the particular power source chosen by the power source router is the battery. In one embodiment, the first power source is approximately five volts, and the battery is approximately three volts. In another embodiment, the power source router module comprises at least two diodes.

Turning now to FIG. 4, a block diagram of a system for detecting a tamper state for a printer compartment is depicted in accordance with an illustrative embodiment. Specifically, FIG. 4 shows tamper detection system 400. Tamper detection system 400 may be implemented in a printer, such as printer 115 in FIG. 1, printer 200 in FIG. 2, and printer 300 in FIG. 3.

Tamper detection system 400 includes printer compartment 405. Printer compartment 405 is a non-limiting example of printer compartment 235 in FIG. 2. In one example, printer compartment 405 is a printer drawer, such as printer drawer 302 in FIG. 3. Also, printer compartment 405 may be part of a printer, such as printer 115 in FIG. 1, printer 200 in FIG. 2, and printer 300 in FIG. 3. In one example, one or more of the components in tamper detection system 400, such as those enclosed by the dotted line representing printer compartment 405, may be included in printer compartment 405. However, any combination of components in tamper detection system 400, or none at all, may be included in printer compartment 405.

Physical switch 410 is coupled to printer compartment 405. Physical switch 410 may be any type of switch that is capable of having at least two states, such as a trembler switch, float switch, key switch, limit switch, read switch, centrifugal switch, hall-effect switch, inertial switch, membrane switch, or toggle switch.

In one embodiment, physical switch 410 may have an open and a closed state. In this embodiment, physical switch 410 may have an open state when printer compartment 405 has not been tampered with. For example, printer compartment 405 may be at rest. In another example, a movement of printer compartment 405 is below a threshold such that the movement does not cause physical switch 410 to change states. In another example, physical switch 410 is coupled to printer compartment 405, and may become closed when printer compartment 405 hits a back wall of the printer, such as printer 300 in FIG. 3.

In this embodiment, physical switch 410 may be adapted to close into a closed state when printer compartment 405 has been tampered with. Printer compartment 405 may be considered to be tampered with if printer compartment 405 undergoes any movement that closes physical switch 410.

The movement that causes physical switch 410 to close may be any of a variety of movements depending on the implementation. In one embodiment, in the example in which printer compartment 405 is a printer drawer, physical switch 410 may be adapted to close when the movement of the printer drawer exceeds a threshold distance. For example, physical switch 410 may close when the printer drawer is pulled by more than a pre-defined distance, such as 5 millimeters, 50 millimeters, 1 inch, or some other suitable distance. The threshold distance may also be a distance that is defined by a law promulgated by a government. These laws may be intended to prevent tampering with fiscal printers.

Tamper detection system 400 includes tamper detection device 415. Tamper detection device 415 is capable of holding charge. In one embodiment, tamper detection device 415 is a capacitor that can have a charged state and non-charged state. In this embodiment, the charged state may be a logic one state and the non-charged state may be a logic zero state.

Charge is provided to tamper detection device 415 by power source 420, battery 425, or a combination thereof. In one embodiment, either or both of these power sources provide charge to tamper detection device 415 when the tamper detection device is in a non-tamper state. Either or both of these power sources may also sustain charge to tamper detection device 415 to counteract any leakage of charge that may occur at tamper detection device 415. Power source router 430 determines the power source that is used to provide charge to tamper detection device 415. In one embodiment, power source router 430 includes two or more diodes. A non-limiting example of this embodiment is provided in greater detail with respect to FIG. 5 below.

In another embodiment, power source 420 is the same power source that provides power to a printer, such as plug-in power source. Power source router 430 may use power source 420 to charge tamper detection device 415 when the printer is turned on. However, when the printer is turned off, power source router 430 may use battery 425 to charge tamper detection device 415. Thus, tamper detection device 415 can maintain a charge whether or not the printer is turned on and whether or not power source 420 is available.

In one embodiment, power source 420 is a five-volt power source and battery 425 is a three-volt power source. However, power source 420 and battery 425 may provide any voltage amount to charge tamper detection device 415.

Using any power source, such as power source 420 or battery 425, current is supplied to tamper detection device 415 through gate switch 435 such that tamper detection device 415 sustains a charge. Gate switch 435 is capable of having at least two states. In one embodiment, gate switch 435 is a transistor.

In one embodiment, gate switch 435 has a first state or a second state. In the first state, current, which is generated by a power source, passes through gate switch 435 such that tamper detection device becomes or remains charged. The first state may also be designated as a logic one state. In the second state, gate switch 435 prevents tamper detection device 415 from charging by preventing the passage of current. The second state may also be designated as a logic zero state.

When printer compartment 405 moves such in a manner that causes physical switch 410 to close, a connection to ground 440 is made via physical switch 410 such that tamper detection device 415 is discharged. When tamper detection device 415 is discharged, tamper detection device 415 indicates a tamper state.

Also, the connection to ground 440 via physical switch 410 causes gate switch 435 to have a logic zero state that prevents the passage of current through gate switch 435. Because no current may pass through gate switch 435, tamper detection device 415 remains discharged and in a tamper state.

In one embodiment, tamper detection device 415 remains discharged even when printer compartment 405 is placed back into an original position. For example, if printer compartment 405 is a printer drawer, tamper detection device 415 remains discharged even when the printer drawer is replaced or pushed back into the pre-tamper position.

The state of tamper detection device 415 may be detected by printer processor 445 using tamper state detection module 450. Tamper state detection module 450 may include one or more diodes. These one or more diodes may prevent the charging of tamper detection device 415 while tamper state detection module 450 detects the state of tamper detection device 415. Thus, printer processor 445 may detect whether tamper detection device 415 is in a tamper state or a non-tamper state.

Furthermore, a storage device in the printer may store data indicating the state of tamper detection device 415. For example, the storage device may record the occurrence of a tamper state of tamper detection device 415. The storage device may also record a history or log of all tamper activity experienced by tamper detection device 415, including a history or log of the states of tamper detection device 415.

In one embodiment, printer processor 445, at any particular moment, may determine that tamper detection device 415 is in a tamper state. In this embodiment, resetting module 455 may change the state of gate switch 435 to a logic one state such that a charge may be provided to tamper detection device 415 by a power source. In one example, resetting module 455 is a transistor. In this example, the transistor of resetting module 455 may allow the passage of current such that gate switch 435 changes to a logic one state. In this example, the transistor of resetting module 455 may charge tamper detection device 415 to a charged or non-tampered state, which causes gate switch 435 to have a logic one state.

In one embodiment, the lines connecting each of the components of tamper detection system 400 each illustrate a coupling between the various components. Thus, each of the components of tamper detection system 400 may be directly or indirectly coupled with another. For example, in this embodiment, power source 420 may be indirectly coupled to tamper detection device 415, while gate switch 435 is directly coupled to physical switch 410.

In the manner illustratively described, tamper detection system 400 allows a physical tampering with printer compartment 405 to be recorded electronically. Thus, a tamper is recorded whether or not visible proof of the tamper exists. Also, because tamper detection device 415 may be restored to a non-tamper state by printer processor 445 using resetting module 455, the need for outside service technicians is eliminated, thereby reducing cost and saving time.

Figure 5:
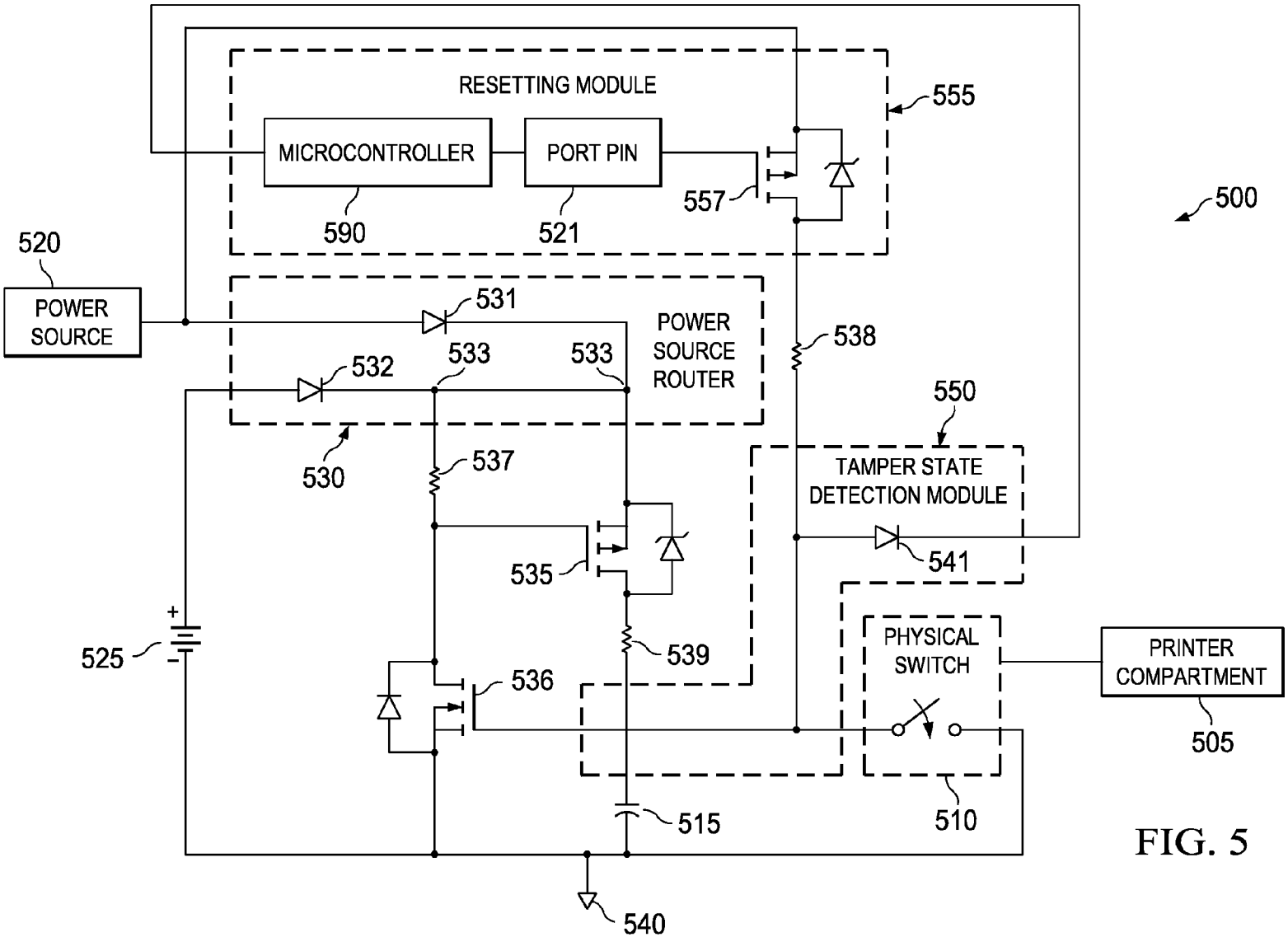
FIG. 5 is a circuit for detecting a tamper state for a printer compartment in accordance with an illustrative embodiment.

Turning now to FIG. 5, a circuit for detecting a tamper state for a printer compartment is depicted in accordance with an illustrative embodiment. Specifically, FIG. 5 shows circuit 500, which is a non-limiting example of tamper detection system 400 in FIG. 4.

In FIG. 5, capacitor 515 is a non-limiting example of tamper detection device 415 in FIG. 4. In one embodiment, resistor 539 may prevent the biasing of capacitor 515. When printer compartment 505 has not been tampered with, physical switch 510 is in an open position and transistor 535 is in a logic one state. Transistor 535 is a non-limiting example of gate switch 435 in FIG. 4. In one embodiment, transistor 535 is a P-type metal-oxide-semiconductor field-effect transistor (MOSFET).

In circuit 500, printer compartment 505 is shown to be coupled to physical switch 510. However, in one embodiment, all or a portion of circuit 500 may be located in printer compartment 505. The determination as to which components to include in printer compartment 505 may be decided using a variety of factors, such as physical space requirements, circuit operation considerations, and cost.

Because transistor 535 is in a logic one state, current provided by either or both of power source 520 and battery 525 flows though transistor 535 and provides charge to capacitor 515. Thus, capacitor 515 is in a non-tamper state.

Power source router 530 is a non-limiting example of power source router 430 in FIG. 4. Power source router 530 includes diodes 531 and 532. The paths emanating from power source 520 and battery 525 intersect at nodes 533.

In one example, power source 520 has a higher voltage than battery 525. In one example, power source 520 is five volts and battery 525 is three volts. In this example, if power source 520 is active, then nodes 533 have the voltage of power source 520. Because nodes 533 have voltage that is higher than battery 525, power source 520, and not battery 525, provides charge to capacitor 515.

However, if power source 520 is not active, then the voltage of nodes 533 drops to a voltage that is below the voltage of battery 525, such as zero volts. Power source 520 may be inactivated if the printer in which circuit 500 is contained is turned off. In the example in which power source 520 is not active, current may stop flowing between diode 531 and transistor 535. In this example, battery 525 provides current to nodes 533 and also maintains or provides charge to capacitor 515. In the example, the battery maintains or charges capacitor 515 to three volts. In this illustrative manner, power source router 530 determines the power source that provides charge to capacitor 515.

Diode 531 prevents battery 525 from discharging through power source 520 when power source 520 is off. Diode 532 prevents power source 520 from charging battery 525 when power source 520 is on.

When printer compartment 505 experiences a movement that qualifies as a tamper, physical switch 510 closes and provides a path to ground 540 for capacitor 515. Because capacitor 515 is grounded, capacitor 515 discharges, and thereby indicates a tamper state.

When capacitor 515 discharges, the gate, to source voltage on transistor 536, shuts transistor 536 off. In one embodiment, transistor 536 is an N-type MOSFET transistor. With no current flowing through transistor 536, no voltage is present across resistor 537, thereby causing transistor 535 to also turn off. In this way, transistor 535 changes to a logic zero state.

Because transistor 535 changes to a logic zero state when physical switch 510 is closed, no current passes though transistor 535. Therefore, no charge can be provided to capacitor 515 by power source 520 or battery 525. In one example, capacitor 515 stays discharged until the printer in which circuit 500 is contained is powered on, and microcontroller 590 sends a command to port pin 521. Microcontroller 590 may be located in printer compartment 505. In one embodiment, microcontroller 590 is a printer processor.

Microcontroller 590 is able to detect whether capacitor 515 is in a tamper or non-tamper state using tamper state detection module 550. Tamper state detection module 550 is a non-limiting example of tamper state detection module 450 in FIG. 4. In one example, when the printer in which circuit 500 is contained is powered on, microcontroller 590 can detect that printer compartment 505 has been tampered with by sampling the state of capacitor 515 through diode 541.

Tamper state detection module 550 includes diode 541. One exemplary function of diode 541 is to prevent microcontroller 590 or any other component of the printer from charging capacitor 515 once capacitor 515 is in a tamper state.

Upon detecting that capacitor 515 is in a tamper state, the printer processor may recharge capacitor 515 using resetting module 555. Resetting module 555 is a non-limiting example of resetting module 455 in FIG. 4, and includes transistor 557. In one embodiment, transistor 557 is a P-type MOSFET transistor. In one example, when the printer in which circuit 500 is contained is powered on, circuit 500 is reset to indicate a non-tamper state by microcontroller 590 setting a particular state for port pin 521.

For example, microcontroller 590 may set port pin 521 to a voltage state or a ground state, which may correspond to a logic state one and zero, respectively. A voltage state, or logic state one, of port pin 521 turns transistor 557 on, thereby allowing current to flow through transistor 557. The current flows through resistor 538 to capacitor 515, thereby charging capacitor 515 to the output voltage of power source 520, such as five volts. On the other hand, a ground state, or logic state zero, of port pin 521 prevents the flow of current through transistor 557. As a result the charging of capacitor 515 is prevented.

The voltage of power source 520 is also detected by the gate to source voltage of transistor 536, thereby causing transistor 536 to turn on and allow the passage of current. The current passing through transistor 536 causes a voltage drop across resistor 537, which forms a negative gate to source voltage on transistor 535. This negative gate to source voltage turns transistor 535 on. The current that then passes through transistor 535 keeps capacitor 515 charged to the voltage output of power source 520 and transistor 557 is shut off.

Figure 6:
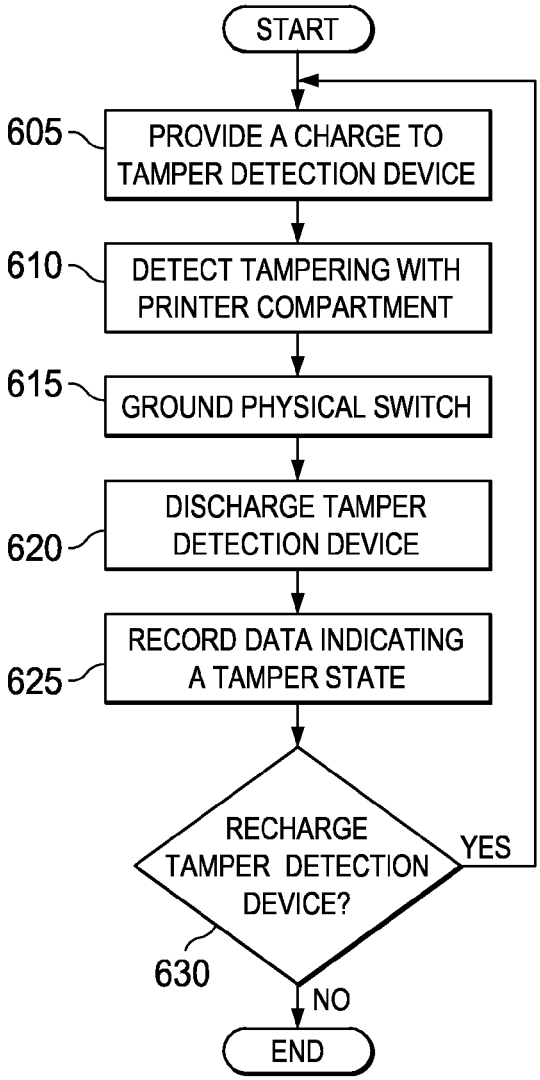
FIG. 6 is a flowchart illustrating a process to detect a tamper state for a printer compartment in accordance with an illustrative embodiment.

Turning now to FIG. 6, a flowchart illustrating a process to detect a tamper state for a printer compartment is depicted in accordance with an illustrative embodiment. The process illustrated in FIG. 6 may be implemented by a tamper detection system, such as tamper detection system 400 in FIG. 4, or a circuit, such as circuit 500 in FIG. 5.

The process begins by providing or sustaining a charge to a tamper detection device (step 605). The process then detects tampering with a printer compartment, such as a printer drawer (step 610). For example, a physical switch may detect tampering with the printer compartment.

The process then closes the physical switch to provide a short to ground for the tamper detection device (step 615). The process then discharges the tamper detection device (step 620). The process then records data indicating the tamper state of the tamper detection device (step 625).

The process then determines whether to recharge the tamper detection device (step 630). If the process determines to recharge the tamper detection device, then the process returns to step 605. If the process determines not to recharge the tamper detection device, then the process ends.

Figure 7:
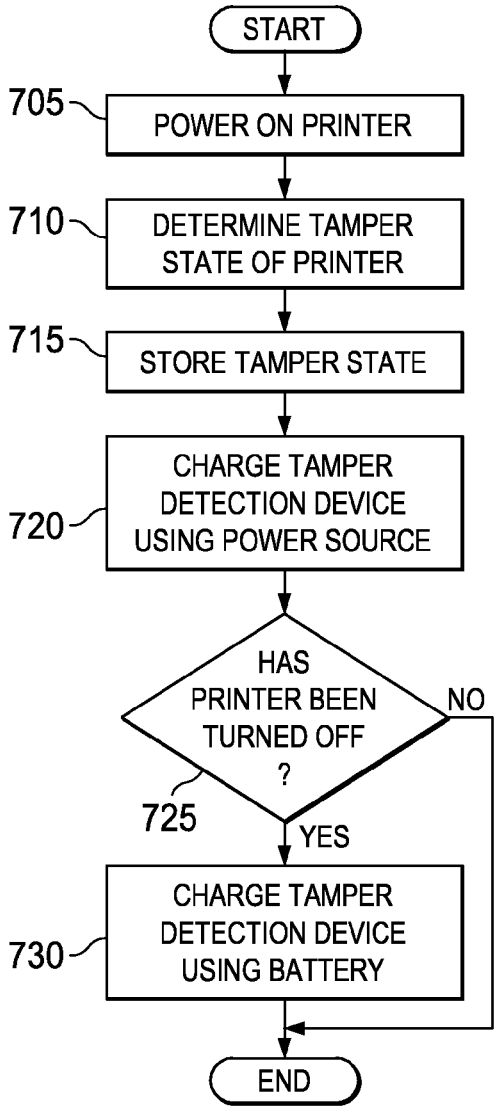
FIG. 7 is a flowchart illustrating a process to detect a tamper state for a printer compartment in accordance with an illustrative embodiment.

Turning now to FIG. 7, a flowchart illustrating a process to detect a tamper state for a printer compartment is depicted in accordance with an illustrative embodiment. The process illustrated in FIG. 7 may be implemented by a tamper detection system, such as tamper detection system 400 in FIG. 4, or a circuit, such as circuit 500 in FIG. 5. Also, the process illustrated in FIG. 7 is a non-limiting example of step 605 in FIG. 6.

The process begins by powering the printer on (step 705). The process determines the tamper state of the printer (step 710). The process stores the tamper state (step 715). For example, the process may store the tamper state in a storage device in the printer or a data processing system connected to the printer.

The process charges the tamper detection device using a power source used by the printer, such as a plug-in power source (step 720). The process determines whether the printer has been turned off (step 725). If the process determines that the printer has not been turned off, then the process terminates. If the process determines that the printer has been turned off, then the process charges the tamper detection device using a battery (step 730). In one embodiment, a battery maintains a charge already present on the tamper detection device when the printer is powered off.

In another embodiment in which a microprocessor is powered on regardless of whether the printer has power, the microprocessor may actually charge the tamper detection device. In this embodiment, the microprocessor may be located outside of the printer. The process then terminates.

The illustrative embodiments described herein provide an apparatus and method for detecting a tamper state for a printer compartment. The apparatus includes a printer having the printer compartment. In one embodiment, the printer is a fiscal printer. The apparatus also includes a switch coupled to the printer compartment.

The switch is adapted to close when tampering with the printer compartment occurs. When the switch is closed, the switch provides an electrical path to ground for at least one component other than the switch.

The apparatus includes a tamper detection device. In one embodiment, the tamper detection device is a capacitor. The tamper detection device is adapted to discharge to indicate a tamper state when the switch is closed. A tamper state is a state of the tamper detection device that indicates that the printer compartment has been tampered with.

In another illustrative embodiment, the printer compartment is a printer drawer. In this embodiment, the switch is adapted to close when a movement of the printer drawer exceeds a threshold distance, such as 5 millimeters. Thus, in this embodiment, the tamper detection device is discharged and indicates a tamper state if the movement of the drawer exceeds a threshold distance.

The apparatus also may include a set of power sources. The set of power sources provides charge to the tamper detection device when the tamper detection device is in a non-tamper state. A non-tamper state is a state of the tamper detection device that indicates that the printer compartment has not been tampered with.

In one illustrative embodiment, the set of power sources comprises a first power source used by the printer and a battery. The first power source may be the same power source that provides power to the printer, such as a plug-in power source.

In this embodiment, the apparatus also includes a power source router. The power source router chooses a particular power source in the set of power sources to provide charge to the tamper detection device when the tamper detection device is in the non-tamper state. For example, when the printer is turned on, the particular power source chosen by the power source router is the first power source. In another example, when the printer is turned off, the particular power source chosen by the power source router is the battery. In one embodiment, the first power source is approximately five volts, and the battery is approximately three volts. In another embodiment, the power source router module comprises at least two diodes.

In the manner described, tamper detection system 400 allows a physical tampering with printer compartment 405 to be recorded electronically. Thus, a tamper is recorded whether or not visible proof of the tamper exists. Also, because tamper detection device 415 may be restored to a non-tamper state by printer processor 445 using resetting module 455, the need for outside service technicians is eliminated, thereby reducing cost and saving time.

The flowcharts and block diagrams in the different depicted embodiments illustrate the architecture, functionality, and operation of some possible implementations of apparatus, methods and computer program products. In this regard, each block in the flowchart or block diagrams may represent a module, segment, or portion of code, which comprises one or more executable instructions for implementing the specified function or functions. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved.

The circuit as described above is part of the design for one or more integrated circuit chips. The chip design is created in a graphical computer programming language, and stored in a computer storage medium (such as a disk, tape, physical hard drive, or virtual hard drive such as in a storage access network). If the designer does not fabricate chips or the photolithographic masks used to fabricate chips, the designer transmits the resulting design by physical means (e.g., by providing a copy of the storage medium storing the design) or electronically (e.g., through the Internet) to such entities, directly or indirectly. The stored design is then converted into the appropriate format (e.g., GDSII) for the fabrication of photolithographic masks, which typically include multiple copies of the chip design in question that are to be formed on a wafer. The photolithographic masks are utilized to define areas of the wafer (and/or the layers thereon) to be etched or otherwise processed.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. An apparatus for detecting tampering, comprising:

a printer;

a printer compartment located within the printer;

a switch capable of being coupled to the printer compartment, wherein the switch is adapted to close when tampering with the printer compartment occurs;

a tamper detection device capable of being in a tamper state and a non-tamper state, wherein the tamper detection device discharges and places the tamper detection device in the tamper state when the switch is closed to indicate that tampering has occurred; and a set of power sources, wherein the set of power sources provides charge to the tamper detection device and places the tamper detection device in the non-tamper state.

2. The apparatus of claim 1, wherein the set of power sources comprises a first power source used by the printer and a battery, further comprising:

a power source router, wherein the power source router chooses a particular power source in the set of power sources to provide charge to the tamper detection device when the tamper detection device is in the non-tamper state.

3. The apparatus of claim 2, wherein the particular power source is the first power source when the printer is turned on.

4. The apparatus of claim 2, wherein the particular power source is the battery when the printer is turned off.

5. The apparatus of claim 2, wherein the first power source is approximately five volts, and wherein the battery is approximately three volts.

6. The apparatus of claim 2, wherein the power source router comprises at least two diodes.

7. The apparatus of claim 1, wherein the printer compartment contains a storage device, and wherein the storage device stores transaction data associated with the printer.

8. The apparatus of claim 1, further comprising:

a gate switch, wherein the gate switch has a first state such that current passes through the gate switch to charge the tamper detection device when the switch is open.

9. The apparatus of claim 8, wherein the gate switch has a second state to prevent the tamper detection device from charging when the switch is closed.

10. The apparatus of claim 9, wherein the tamper detection device is in the tamper state, further comprising:

a printer processor, wherein the printer processor determines that the tamper detection device is in the tamper state, and a resetting module, wherein the resetting module changes a state of the gate switch to the first state to facilitate charging of the tamper detection device.

11. The apparatus of claim 10, wherein the gate switch comprises a transistor, and wherein the resetting module comprises a second transistor.

12. The apparatus of claim 1, wherein the tamper detection device comprises a capacitor.

13. The apparatus of claim 1, wherein the printer compartment is a printer drawer, and wherein the switch is adapted to close when a movement of the printer drawer exceeds a threshold distance.

14. The apparatus of claim 1, wherein the tamper detection device is grounded when the tampering with the printer compartment occurs.

15. The apparatus of claim 1, further comprising:

a tamper state detection module, wherein the tamper state detection module is used by a printer processor to determine a state of the tamper detection device, wherein the state is one of the tamper state and the non-tamper state.

16. The apparatus of claim 15, wherein the tamper state detection module comprises a diode.

17. The apparatus of claim 1, further comprising:

a storage device, wherein the storage device records data indicating an occurrence of the tamper state.

18. The apparatus of claim 17, wherein the printer is a fiscal printer.

19. A method for detecting tampering, comprising:

moving the printer compartment, wherein the printer compartment is coupled to a printer;

responsive to a tampering of the printer compartment, closing a switch, wherein the switch is coupled to the printer compartment; and responsive to closing the switch, discharging a tamper detection device to indicate a tamper state, wherein a set of power sources provide charge to the tamper detection device while the tamper detection device indicates a non-tamper state.

20. An apparatus for detecting tampering, comprising:

a fiscal printer;

a printer compartment located within the fiscal printer, wherein the printer compartment is a printer drawer;

a switch capable of being coupled to the printer compartment, wherein the switch is adapted to close when tampering with the printer compartment occurs;

a tamper detection device capable of being in a tamper state and a non-tamper state, wherein the tamper detection device discharges and places the tamper detection device in the tamper state when the switch is closed to indicate that tampering has occurred, and wherein the tamper detection device comprises a capacitor;

a set of power sources, wherein the set of power sources provides charge to the tamper detection device and places the tamper detection device in the non-tamper state, wherein the set of power sources comprises a first power source used by the fiscal printer and a battery; and a tamper state detection module, wherein the tamper state detection module is used by a printer processor to determine a state of the tamper detection device, wherein the state is one of the tamper state and the non-tamper state.

* * * * *